US005797734A

United States Patent [19]

Kizer et al.

[11] Patent Number: 5,797,734

[45] Date of Patent: Aug. 25, 1998

[54] PUMP FOR HOT AND COLD FLUIDS

[75] Inventors: Thomas L. Kizer, Farmington Hills; Richard G. Reed, Jr., Royal Oak, both of Mich.

[73] Assignee: Chrysler Corporation, Auburn Hills, Mich.

[21] Appl. No.: 756,617

[22] Filed: Nov. 26, 1996

[51] Int. Cl.[6] ..... F04C 2/10; F04C 13/00

[52] U.S. Cl. ..... 418/9; 418/171; 418/179

[58] Field of Search ..... 418/9, 15, 152, 418/166, 171, 179

[56] References Cited

U.S. PATENT DOCUMENTS

| | | | |
|---|---|---|---|
| 2,337,903 | 12/1943 | Lauck | 418/152 |
| 2,956,512 | 10/1960 | Brundage | 418/171 |
| 2,966,118 | 12/1960 | McAlvay | 418/9 |
| 3,272,130 | 9/1966 | Mosbacher | 418/9 |
| 3,288,034 | 11/1966 | White, Jr. et al. | 418/61.3 |
| 3,459,337 | 8/1969 | Williamson | 418/152 |
| 3,722,329 | 3/1973 | Van Hecke et al. | 81/10 |
| 4,992,034 | 2/1991 | Uppal | 418/61.3 |
| 5,139,395 | 8/1992 | Kemmner | 418/171 |
| 5,618,171 | 4/1997 | von Behr et al. | 418/152 |

FOREIGN PATENT DOCUMENTS

| | | | |
|---|---|---|---|
| 1-182585 | 7/1989 | Japan | 418/152 |
| 4-148090 | 5/1992 | Japan | 418/15 |

*Primary Examiner*—John J. Vrablik

*Attorney, Agent, or Firm*—Kenneth H. MacLean

[57] ABSTRACT

A gear-type pump having an inner rotor and an outer rotor and in which the outer rotor is supported for rotation by a plurality of roller bearings interposed between a support housing and the outer rotor and in which the inner and outer rotors and the support housing are made of the same material and have essentially the same width dimension so that the thermal contraction of the support housing and the thermal contraction of the inner and outer rotors while pumping super-cooled fluid does not adversely affect the end-clearance between the end plates and the inner and outer rotors to an extent where the efficiency of the pump would differ if it were pumping fluid at a temperature of 70 degrees Fahrenheit.

10 Claims, 4 Drawing Sheets

FIG-6
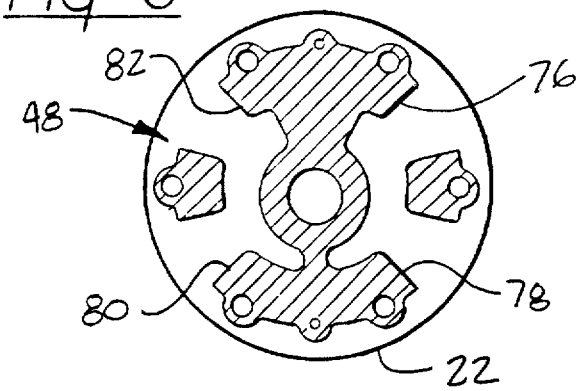
FIG-7
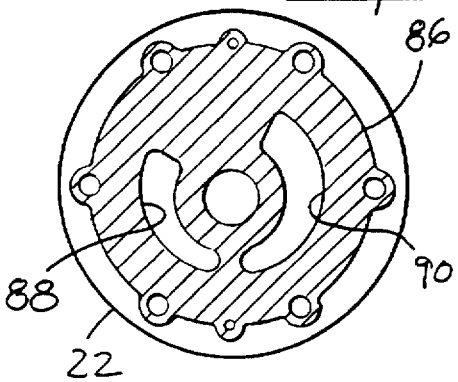
FIG-8
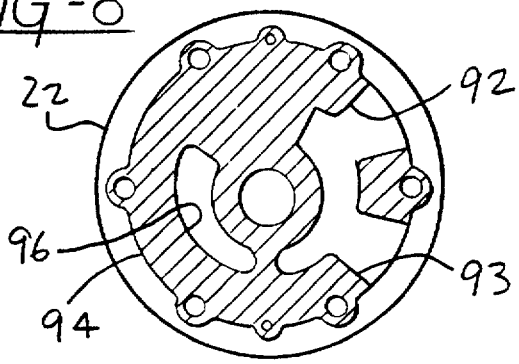
FIG-9
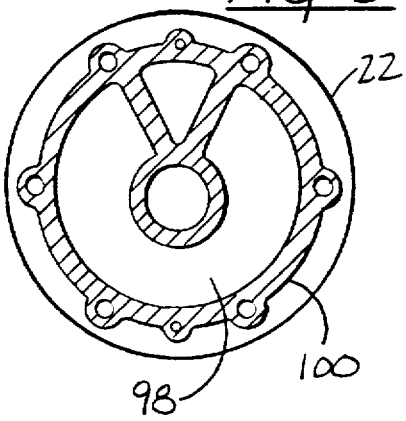
FIG-10
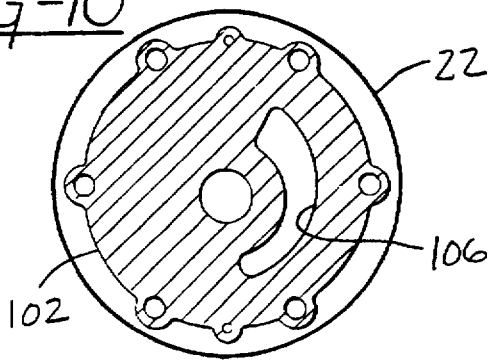
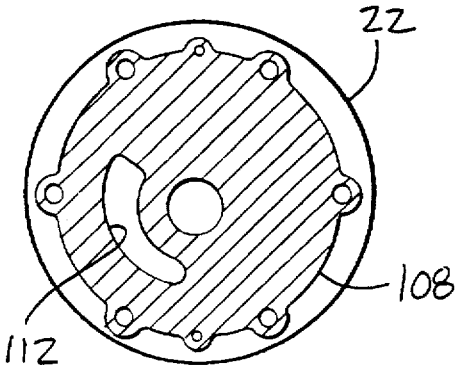
FIG-11
FIG-12
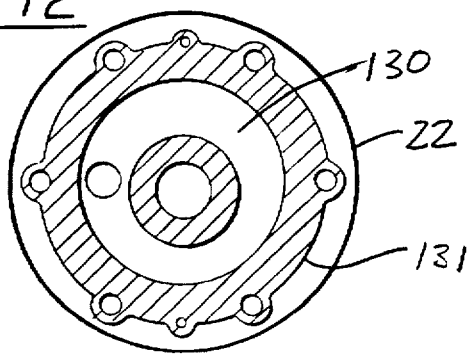

PUMP FOR HOT AND COLD FLUIDS

This invention concerns hydraulic devices and more particularly relates to a hydraulic pump that provides efficient operation when used with fluids at extremely cold temperatures and at extremely hot temperatures and at temperatures therebetween.

BACKGROUND OF THE INVENTION

Internal gear pumps and gerotor pumps are positive displacement fluid pumps the design of which is based on the use of a gear with teeth around the outer perimeter of an inner rotor engaged by the gear teeth around the inner perimeter of a larger ring-shaped rotor. The axes of rotation of the two rotors are displaced one from the other by a distance equal to the difference between the pitch radii of the two gears or rotors. In addition, the axes of rotation of the two rotors are maintained by the inner rotor being mounted to a bearing supported shaft and the outer rotor supported within a cylindrical bore that is rigidly located relative to the center of rotation of the shaft of the inner rotor.

As is conventional, the outer rotor of the internal gear pump and the outer rotor of the gerotor pump each rotate within the cylindrical bore of the pump housing. In the presence of the fluid being pumped, the outer cylindrical surface of the rotating outer rotor and the stationary housing cylindrical bore act as a hydrodynamic journal bearing. Thus, when the pump is used to pump fluids such as oils having high lubricity and viscosity a "bearing effect" is realized, i.e. the film of oil between the peripheral surface of the rotating outer rotor and the inner surface of the stationary cylindrical bore serves to reduce friction and bear loads without wear. The effectiveness of the "bearing effect" depends upon many factors not the least of which is the lubricity and the viscosity of the fluid being pumped vis-a-vis the relative speed of the parts and the load applied to the film of the fluid. As in the case of most hydrodynamic journal bearing designs, it is generally considered a necessity that the outer rotor and the housing be made of different materials because of a tendency for the affinity of like materials to experience some molecular bonding and material transfer when in contact under load.

When pumps of the type described above are used to pump fluids with low lubricity and viscosity, the bearing effect does not work well and special care is usually taken to ensure that the materials selection for the rotor and housing result in a combination that is wear resistant in the presence of such fluids. Moreover, a design parameter that must be controlled carefully in these pumps in order that the efficiency of the pumps be kept as high as possible is the "end-clearance", i.e. the axial clearance between the ends of the inner and outer rotors and the end plates of the pump. As is well known, the end-clearance represents a leak path from the high pressure cavity to the low pressure cavity of the pump and is controlled by making the housing thickness equal to the thickness of the rotors plus the desired end-clearance. When flat end plates are fastened to the housing, the sum of the two clearances between the plates and the rotors provides the end-clearance. If the end-clearance is too large, an excessive amount of fluid will leak from the high pressure side to the low pressure side of the pump and higher than necessary efficiency losses will occur. If the viscosity of the fluid being pumped is low, then the clearance between the rotors and the end plates must be kept very small so that the leakage is minimized and the efficiency kept high since low viscosity fluids tend to flow freely.

The necessity of having the outer rotor and the housing made of different materials as explained above, means that they necessarily have different coefficients of thermal expansion resulting in the end-clearance varying as the temperature of the pump varies. Since the end-clearance will vary with the temperature, then the leakage and pump efficiency will also vary with the temperature. In order for the pump end-clearance to be at a specified dimension at a predominant operating temperature, the pump drawing dimensions must be adjusted by the thermal growth or shrinkage difference between the expected operating temperature and the manufacturing temperature.

Accordingly, there is a need for pumps of the above-described type to be made so as to efficiently and durably pump fluids at widely varying temperatures and/or viscosities and/or lubricates without wear, with low friction and with high and constant efficiency.

SUMMARY OF THE INVENTION

Stately broadly, the present invention contemplates a gear pump, such as an internal gear pump or a gerotor pump, wherein the inner and outer rotors are of the same thickness and in which the support housing for the pump is constructed of exactly the same material as the material of the two rotors. Arrayed peripherally around the outside of the outer rotor and the inside of the housing bore are cylindrical rollers made of a material different than the material of the rotors and housing to avoid the aforementioned material transfer tendency. The use of the rollers to separate the outer rotor from the housing reduces the friction between the rotating outer rotor and the housing resulting in reduced power being required to rotate the pump therefore higher overall efficiency. To achieve the correct end-clearance, the housing thickness is dimensioned to be equal to the rotor thickness plus the desired operating end-clearance without regard to the difference between normal manufacturing temperature and desired operating temperature. It is necessary that the thicknesses of the inner rotor, outer rotor and housing be as specified when they are all at the same temperature. When the end plates are fastened to the housing, the end-clearance will be equal to the difference between the housing thickness and the rotor thickness. The end-clearance will normally be a very small dimension; on the order of a few ten-thousandths of an inch.

One application for a pump according to the present invention can be the fuel system of an automotive vehicle natural gas-powered engine. More specifically, such pump can be used for pumping liquefied natural gas (LNG) from a storage tank to the engine be it a conventional piston type internal combustion engine or a turbine engine. One advantage in using LNG is that it is twice a dense as compressed natural gas (CNG) and thereby allows substantially more on-board storage than CNG and thus much greater vehicle range. However, LNG is transformed from natural gas by cooling and condensing the natural gas to approximately −260 degrees Fahrenheit. Because LNG in its normal state is at a super-cooled temperature and also because LNG inherently has a low lubricity and low viscosity, it has been found that the pump according to the present invention lends itself well for use in pumping such fuel from an insulated storage tank to the engine.

Accordingly, one object of the present invention is to provide a new and improved positive displacement hydraulic pump for use with super-cooled and super-heated fluids and for use with fluids at a temperature between the temperatures of the super-cooled and superheated fluids.

Another object of the present invention is to provide a new and improved gear-type pump having an inner rotor and an outer rotor and in which the outer rotor is supported for rotation by a plurality of cylindrical roller bearings interposed between a support housing and the outer rotor and in which the inner and outer rotors are made of the same material and have essentially the same width dimension as the support housing so that the thermal contraction of the support housing and of the inner and outer rotors while pumping super-cooled fluid does not adversely affect the end-clearance between the end plates and the rotors to an extent where the efficiency of the pump would differ if it were pumping fluid at a temperature of 70 degrees Fahrenheit.

A further object of the present invention is to provide a new and improved gear-type positive displacement hydraulic pump having an inner rotor and an outer rotor with the inner rotor having at least one less tooth than the outer rotor and has its centerline positioned at a fixed eccentricity from the centerline of the outer rotor and in which the outer rotor is supported for rotation by a plurality of cylindrical roller bearings interposed between a support housing and the outer rotor and in which the rotors are made of the same material and have essentially the same width dimension as the support housing so that the thermal contraction of the support housing and rotors while pumping super-cooled fluid does not adversely affect the end-clearance between the end plates and the rotors to an extent where the efficiency of the pump would differ if it were pumping fluid at a temperature of 70 degrees Fahrenheit.

A still further object of the present invention is to provide a new and improved multi-stage gear-type pump in which each stage of the pump has an inner rotor and an outer rotor and in which the outer rotor is supported for rotation by a plurality of cylindrical roller bearings interposed between a support housing and the outer rotor and in which the rotors are made of the same material and have essentially the same width dimension as the support housing so that the thermal contraction or the thermal expansion of the support housing and the rotors while pumping super-cooled fluid or super heated fluid does not adversely affect the end-clearance between the end plates and the rotors to an extent where the efficiency of the pump would differ if it were pumping fluid at a temperature of 70 degrees Fahrenheit.

A still further object of the present invention is to provide a new and improved multi-stage gear-type hydraulic pump in which each stage of the pump includes an inner rotor and an outer rotor and in which at least one stage between the first and last stage of the pump has the gear teeth of the inner and outer rotors offset approximately one-half tooth relative to the immediately adjacent stage of the pump so as to avoid hydraulic locking caused by uneven flow of the fluid.

BRIEF DESCRIPTION OF THE DRAWINGS

Other objects, advantages, and features of the present invention will be apparent from the following detailed description when taken with the drawings in which:

FIGS. 6, 7, 8, 9, 10, 11, and 12 are sectional views of the gear-type hydraulic pump taken on lines 6—6, 7—7, 8—8, 9—9, 10—10, 11—11, and 12—12, respectively, but shown in reduced size.

DETAILED DESCRIPTION OF EMBODIMENT SHOWN IN THE DRAWINGS

Figure 1:
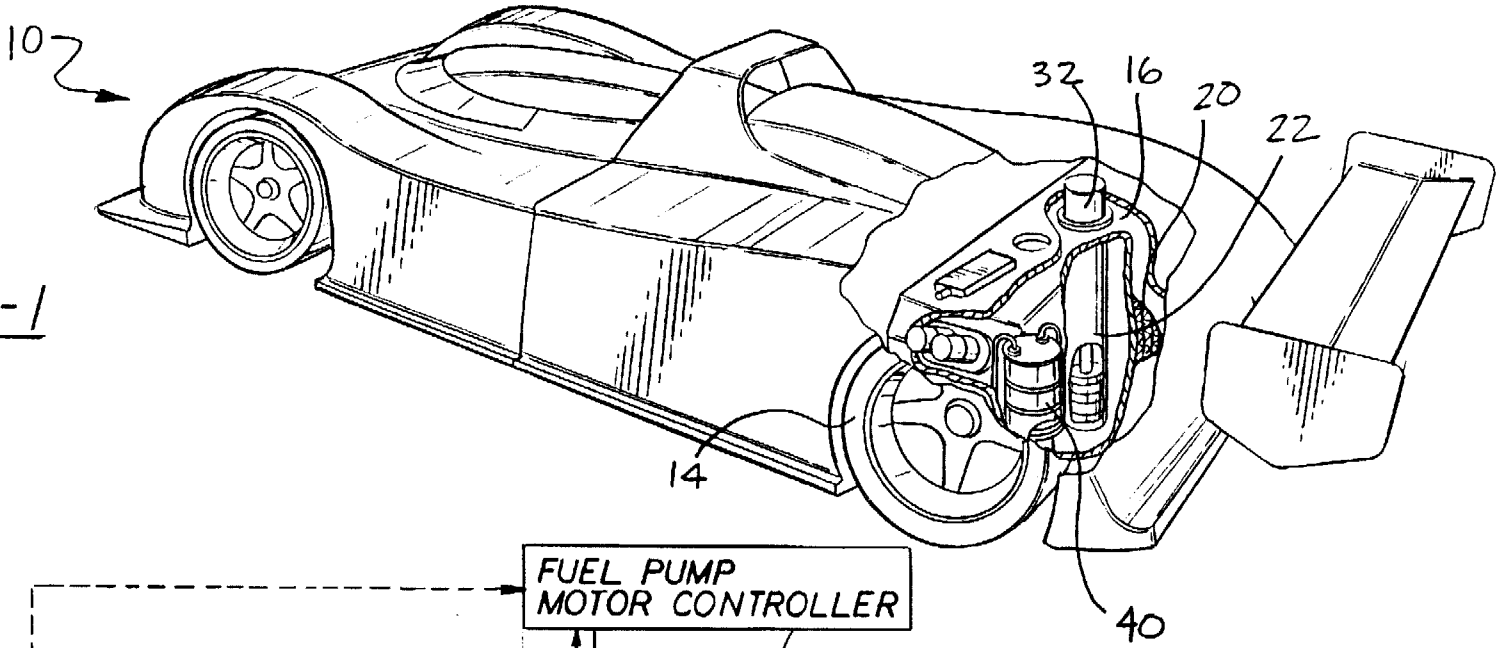
FIG. 1 is a perspective view of an automotive vehicle having a fuel delivery system incorporating a gear-type hydraulic pump made in accordance with the present invention.
Figure 2:
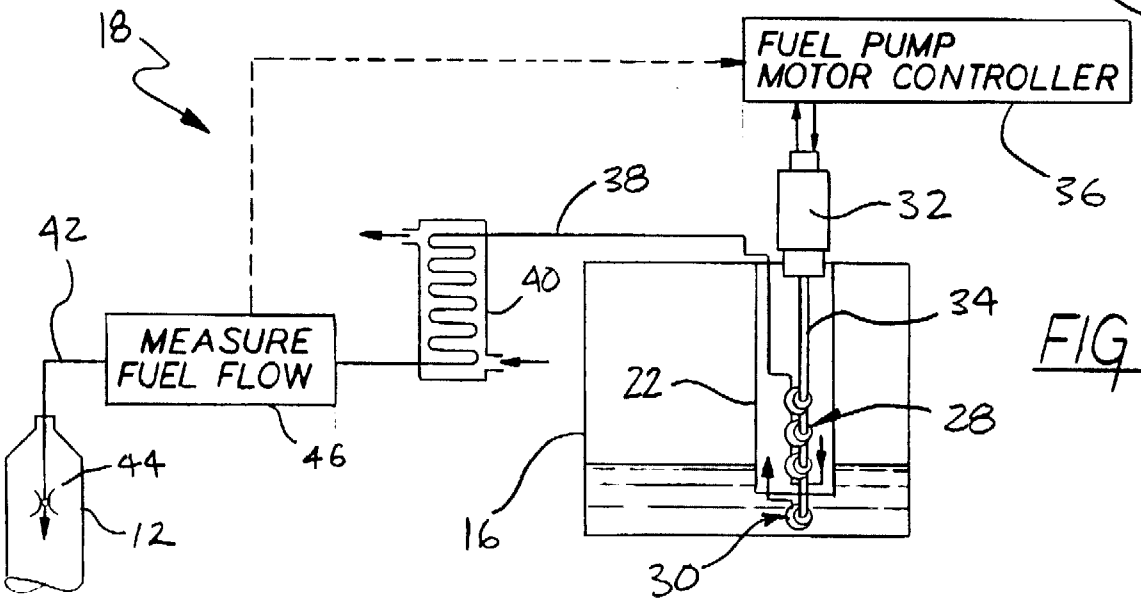
FIG. 2 is a schematic diagram of a part of the fuel delivery system incorporated in the automotive vehicle of FIG. 1.

Referring to the drawings and more particularly FIGS. 1 and 2 thereof, an automotive vehicle 10 of the racing type is shown equipped with a hybrid power train which includes a gas turbine engine 12 which drives an alternator (not shown), a flywheel (not shown) for storing the excess energy generated by the gas turbine engine 12, and an electric traction motor (not shown) for driving the rear wheels 14 of the vehicle. The turbine engine 12 is intended to run at a near constant speed to allow it to burn fuel more efficiently while the flywheel converts the latent electrical energy supplied by the alternator to rotational energy and stores it by spinning at a high rpm. The flywheel's latent energy is converted back to electricity and used when needed for maximum acceleration of the vehicle out of corners and down straightaways.

In this case, the fuel used to power the turbine engine 12 is natural gas and, in order to provide a greater range for the vehicle, the natural gas takes the form of a super-cooled liquid which is stored in an insulated storage tank 16 carried by the vehicle. As is well known, liquefied natural gas or LNG is transformed from natural gas by cooling and condensing the natural gas to approximately −260 degrees Fahrenheit. One advantage in using natural gas as a fuel is that natural gas powered engines have the potential for cleaner combustion than do conventional hydrocarbon fueled engines.

Figure 3:
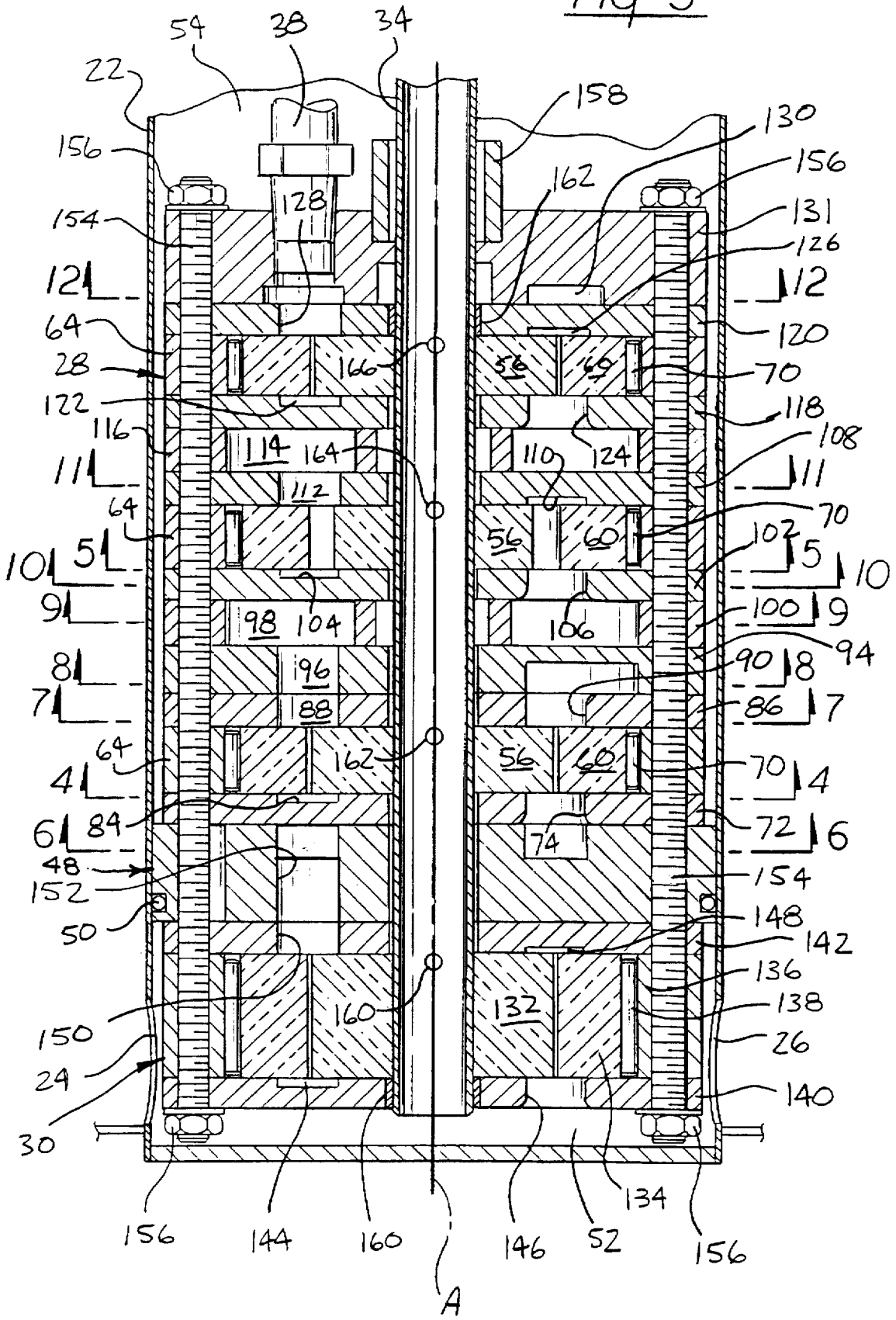
FIG. 3 is a cross-sectional view of the gear-type hydraulic pump made according to the present invention and incorporated in the fuel delivery system seen in FIG. 2.

As seen in FIG. 2, a part of a fuel delivery system 18 is shown for the vehicle 10. The fuel delivery system 18 includes the storage tank 16 for the LNG. The storage tank 16 is covered with a foam insulation material 20 which serves to maintain the natural gas in a liquefied state. A secondary fuel storage tank 22 is located within the primary storage tank 16. The secondary fuel tank 22 takes the form of a cylinder having a pair of diametrically opposed inlet ports 24 and 26 at its lower end as seen in FIG. 3. Located within the secondary fuel tank 22 is a three-stage gerotor fuel pump 28, made according to the present invention, which is combined with a scavenge pump 30. As will more fully be explained hereinafter, the scavenge pump 30 also takes the form of a gerotor and serves to maintain the secondary fuel tank 22 filled with the LNG so that the gerotor fuel pump 28 is primed to operate at all times.

Both the gerotor fuel pump 28 and the scavenge pump 30 are driven by a variable speed electric motor 32 mounted on top of the storage tank 16 and drivingly connected to the pumps 28 and 30 by a shaft 34. During operation, a fuel pump motor controller 36 activates the electric motor 32 and regulates the speed thereof. The electric motor 32, drives the gerotor fuel pump 28 and the scavenge pump 30 causing the LNG to be pressurized and flow via a line 38 to a vaporizer 40. The vaporizer 40 uses warm water and waste heat from the turbine intercooler circuit (not shown) to change the LNG to a gas. The gas exists the vaporizer 40 and flows through a fuel supply line 42 to the combustion chamber 44 of the turbine engine 12. Suitable temperature and pressure sensors 46 are provided in the supply line 42 for measuring the pressure and temperature to determine the density of the gas as it flows to the combustion chamber 44. The data provided by the sensors 46 is fed to a suitable power controller (not shown) which controls the speed of the electric motor 32 through the fuel pump motor controller 36.

FIGS. 3–12 show the detailed construction of the three-stage gerotor fuel pump 28 and the scavenge pump 30. As best seen in FIG. 3, the scavenge pump 30 is located in the lower portion of the secondary fuel tank 22 below the gerotor fuel pump 28 and adjacent the inlet ports 24 and 26 formed in the tank 22. The scavenge pump 30 is physically separated from the gerotor fuel pump 28 by a disk-shaped divider member 48. The divider member 48 is provided with an 0-ring seal 50 which is in peripheral contact with the inner wall of the secondary tank 22 and serves to divide the tank 22 into a lower chamber 52 and an upper chamber 54 for reasons which will be explained hereinafter.

Figure 4:
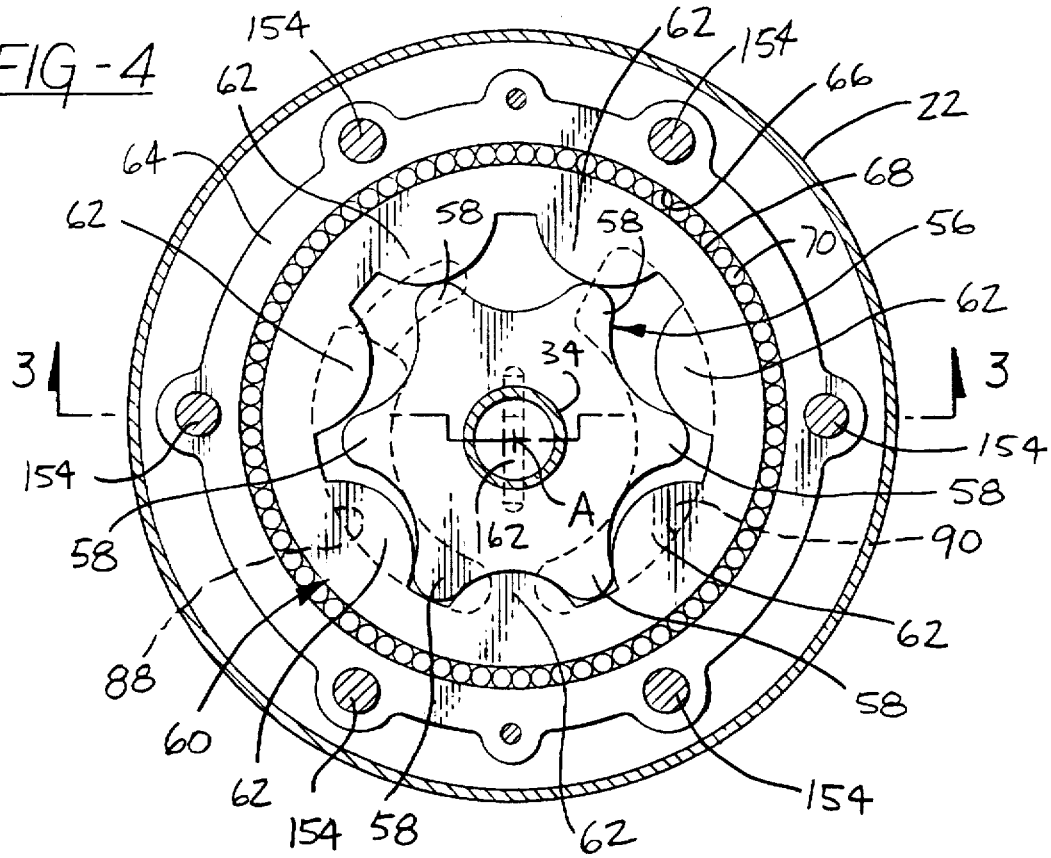
FIGS. 4 and 5 are sectional views of the gear-type hydraulic pump taken on lines 4—4 and 5—5, respectively, of FIG. 3.
Figure 5:
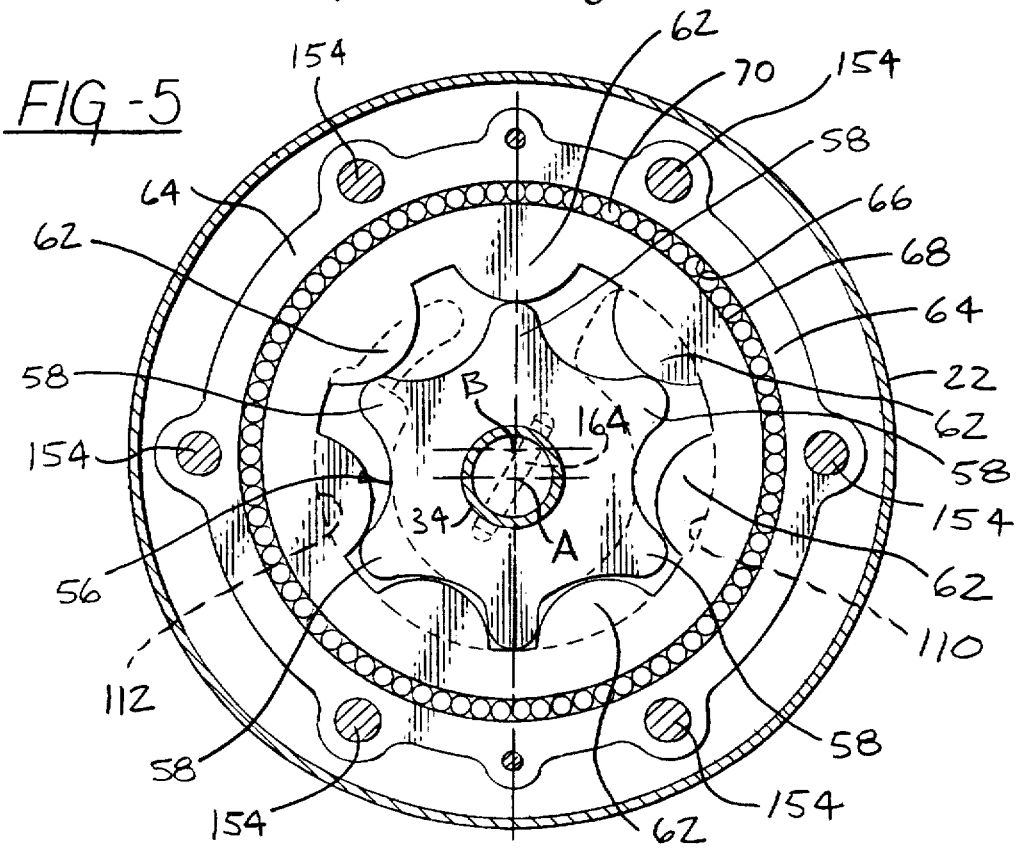

With reference to FIGS. 3–5, it will be noted that the gerotor fuel pump 28 is positioned above the scavenge pump 30 and each of the three stages of the gerotor fuel pump 28, which will be referred to hereinafter as Stage I, Stage II, and Stage III, includes an identical inner rotor 56 formed with six external teeth 58 and an identical ring-shaped outer rotor 60 having seven internal teeth 62. As is usually the case with a gerotor pump, the inner rotor 56 has one less tooth than the outer rotor 60 and has its rotational axis "A" coincidental with the rotational axis of the drive shaft 34. Moreover, as best seen in FIG. 5, the rotational axis "A" of the inner rotor 56 and of the drive shaft 34 is offset from the rotational axis "B" of the outer rotor 60. Also, as is conventional with a gerotor pump, the external teeth 58 of the inner rotor 56 and the internal teeth 62 of the outer rotor 60 are provided with generated tooth profiles for maintaining continuous fluid tight contact during rotation of the rotors 56 and 60.

At each stage of the gerotor fuel pump 28, the inner rotor 56 and the outer rotor 60 are circumferentially encased within a ring-shaped stationary support housing 64 having an inner cylindrical surface 66 which is concentric with an outer cylindrical surface 68 of the outer rotor 60. A plurality of identical cylindrical roller bearings 70 are interposed between the inner cylindrical surface 66 of the support housing 64 and the outer cylindrical surface 68 of the outer rotor 60 for allowing the outer rotor 60 to rotate relative to the support housing 64 with a minimum of friction. In addition and as will be more fully explained below, each stage of the gerotor fuel pump 28 includes a pair of end plate members provided with suitable porting for allowing the LNG to enter the pump 28 at a predetermined pressure and exit the pump 28 at a higher pressure.

In this regard and as seen in FIG. 3, Stage I of the gerotor fuel pump 28 has a lower end plate 72 provided with an inlet port 74 which communicates with two side inlet ports 76 and 78 formed in the divider member 48 as seen in FIG. 6. (The divider member 48 also has two side outlet ports 80 and 82 which communicate with the scavenger pump 30 as will be explained hereinafter.) The lower end plate 72 is also formed with a so-called "shadow port" 84, which is actually a recess of a predetermined shape and depth, for balancing side loads imposed upon the rotors 56 and 60 during its pumping operation. The same Stage I of the gerotor fuel pump 28 has an upper end plate 86 provided with a high pressure outlet port 88 and a low pressure inlet port 90 as seen in FIGS. 3 and 7. The inlet port 90 communicates with a pair of side inlet ports 92 and 93 formed in an inlet plate 94 while the high pressure port 88 registers with an outlet port 96 also formed in the inlet plate 94 as seen in FIG. 8. The outlet port 96 of the inlet plate 94, in turn, communicates with a chamber 98 formed in a transfer ring 100 seen in FIG. 9.

Stage II of the gerotor fuel pump 28 has a lower end plate 102 which is structurally identical to the lower end plate 72 of Stage I of the gerotor fuel pump 28. The lower end plate 72 includes a shadow port 104 and an inlet port 106 which can be seen in FIG. 10 and which communicates with the chamber 98 of the transfer ring 100. Stage II also includes an upper end plate 108 provided with a shadow port 110 and an outlet port 112 which can be seen in FIG. 11. The outlet port 112 communicates with a chamber 114 of a transfer ring 116 which is structurally identical to the transfer ring 100.

Stage III of the gerotor fuel pump 28 includes a lower end plate 118 and an upper end plate 120 which are identical in construction to the lower end plate 102 and the upper end plate 108, respectively, of Stage II of the pump 28. The lower end plate 118 has a shadow port 122 and an inlet port 124 while the upper end plate 120 is formed with a shadow port 126 and an outlet port 128. The outlet port 128 of the upper end plate 120 communicates with a chamber 130 formed in a top plate 131 as seen in FIG. 12. The chamber 130 connects with the aforementioned line 38 of the fuel delivery system 18 shown in FIG. 2.

As alluded to hereinbefore, the scavenge pump 30 takes the form of a gerotor pump and includes an inner rotor 132 and an outer rotor 134 which are identical in construction to the corresponding rotors of Stage I of the gerotor fuel pump 28 except for having a larger width dimension. Also, as in the case of Stage I of the gerotor fuel pump 28, the inner and outer rotors 132 and 134 are circumferentially encased within a ring-shaped support housing 136 with a plurality of cylindrical roller bearings 138 interposed between the inner cylindrical surface of the support housing 136 and the outer cylindrical surface of the outer rotor 134. In addition, the scavenge pump 30 includes a lower end plate 140 and an upper end plate 142 which are structurally identical to the corresponding end plates provided in Stage III of the gerotor fuel pump 28. Thus, the lower end plate 140 is formed with a shadow port 144 and an inlet port 146 while the upper end plate 142 is formed with a shadow port 148 and an outlet port 150. The outlet port 150 registers with a passage 152 formed in the divider member 48 which communicates with the side inlet ports 80 and 82, as seen in FIG. 6, which lead to the upper chamber 54 of the secondary tank 22.

As seen in FIG. 3, all of the parts described above of the scavenge pump 30 and of the gerotor fuel pump 28 are sealingly secured together by a plurality of circumferentially spaced fastener assemblies each of which consists of an elongated threaded rod 154 provided with a nut and a washer combination 156 at each end of the rod. Also, a support tube 158 has its lower end fixed within a bore formed in the upper surface of the top plate 131 while the upper end of the support tube 158 serves to support the electric motor 32. The drive shaft 34 extends through the support tube 158 and is rotatably supported by a pair of bushings 160 and 162 one of which is fixed in a bore located in the lower end plate 140 and the other which is fixed in a bore formed in the upper end plate 120.

As mentioned hereinbefore, the drive shaft 34 is drivingly connected to the gerotor fuel pump 28 and the scavenge pump 30. In this regard and as seen in FIGS. 3–5, the drive shaft is secured to the inner rotor 132 of the scavenge pump 30 by a transversely extending pin 160. Similarly, the drive shaft 34 is secured to the inner rotor of Stages I, II, and III by transversely extending pins 162, 164, and 166, respectively. It will be noted that the inner rotor 132 of the scavenge pump 30 and the inner rotors 46 of Stages I and III of the gerotor fuel pump 28 can be located in the position seen in FIG. 4 when the electric motor 32 is deenergized. At such time, however, the inner rotor 56 of Stage II will not be in the same relative position but, instead, will be offset one-half tooth in a clockwise direction as seen in FIG. 5. It has been found that by offsetting the middle stage one-half tooth, pressure spikes are reduced and hydraulic locking which may be caused by uneven low of the fluid is avoided during operation of the pumps 28 and 30.

As is conventional with gerotor pumps of the type described above, the inlet port and the outlet port of the scavenge pump 30 and of each of the three stages of the gerotor fuel pump are located relative to the associated inner and outer rotors so that rotation of the inner rotor and the outer rotor creates a vacuum in the form of an expanding chamber adjacent the inlet port for drawing fluid therein while simultaneously creating a contracting chamber adjacent the outlet port for forcing the fluid through the outlet port at a higher pressure. Accordingly, when the electric motor 32 is energized, the rotors 56 and 60 of the three-stage gerotor fuel pump 28 and the rotor 132 and 134 of the scavenge pump 30 are simultaneously drivingly rotated. This causes the scavenge pump 30 to draw the LNG located in the lower chamber 52 of the tank 22 through the inlet port 146 into the expanding chamber of the pump 30 and, as the chamber created by the rotating rotors 132 and 134 contracts, force the LNG through the outlet port 150 and via side outlet ports 80 and 82 (FIG. 6) into the upper chamber 54 of the secondary tank 22. At the same time, the LNG in the upper chamber 54 of the secondary tank 22 is drawn through the side inlet ports 76, 78, 92, and 93 and through the inlet port 74 of the lower end plate 72 into the expanding chamber of Stage I of the gerotor fuel pump 28. As the rotors 56 and 60 cause the expanding chamber to contract, the LNG is forced through outlet ports 88 and 96 at a higher pressure into the chamber 98 seen in FIG. 9 within the transfer ring 100 and then through the inlet port 106 of the second stage of the gerotor fuel pump 28 for further pressurization by Stage II of the pump. The further pressurized LNG by Stage II of the pump 28 is then discharged through outlet port 112 into chamber 114 of the transfer ring 116 wherefrom the fluid enters Stage III of the pump 18 through inlet port 124. The LNG is then further pressurized by the rotors 56 and 60 of Stage III and discharged at a still higher pressure into the chamber 130 wherefrom the fluid flows through the line 38 to the vaporizer 40. The intent is to pressurize the LNG one hundred pounds per square inch at each stage of the gerotor fuel pump 28 so that the LNG exits via the line 38 at a pressure of 300 psi.

As aforementioned, a design parameter that must be controlled carefully in pumps of the above-described type in order that the efficiency of the pumps be kept as high as possible is the end-clearance because it represents a leak path from the high pressure cavity to the low pressure cavity of the pump. In this case, the end-clearance of each stage of the gerotor fuel pump is controlled by making the support housing thickness equal to the thickness of the associated inner and outer rotors plus the desired end-clearance. It has been found that when pumping super-cooled fluid such as LNG which has low lubricity and viscosity, the sum of the two clearances between the upper and lower end plates and the rotors (the end-clearance) at each stage of the gerotor fuel pump 28 should be a very small dimension and preferably only a few ten-thousands of an inch. In order to maintain efficiency of the gerotor fuel pump 28, it has also been found that the material of the rotors 56 and 60 at each stage of the gerotor fuel pump 28 and the material of the associated support housing 64 at each stage must be identical. In one sample of the a gerotor fuel pump made in accordance with this invention, the inner and outer rotors 56 and 60 as well as the associated support housing 64 were made of carbon steel, with at least a HRC 58. Also, the inner and outer rotors 56 and 60 were of a Type 6170 made by Nichols Portland Division of Parker Hannifin Corporation whose address is 2400 Congress Street, Portland, Me. 04102. The roller bearings were made of stainless steel and were one eighth inch in diameter and seven sixteenths in length. The end clearance at each stage of the gerotor fuel pump was five ten-thousands of an inch. The following specifications and calculation shows that this sample gerotor fuel pump when used for pumping LNG as explained above will experience an end-clearance change of only 0.2%.

DESIGN CRITERIA AND SPECIFICATIONS FOR THE PUMP

DESIGN OPERATING TEMPERATURE = −260° F.

MANUFACTURING TEMPERATURE (AMBIENT) = 70° F.

$\Delta T$= −330° F. from MANUFACTURING TEMPERATURE TO OPERATING TEMPERATURE $t_{ROTOR}$ = ROTOR THICKNESS = 0.5000 INCHES @ DESIGN TEMPERATURE OF −260° F.

$t_{HOUSING}$ = HOUSING THICKNESS = 0.5005 INCHES @ DESIGN TEMPERATURE OF −260° F.

DESIGN END CLEARANCE = 0.0005 INCHES (TOTAL BOTH ENDS)

$\alpha_{BRASS} = 11.3 \times 10^{-6}$ IN/IN − °F. LINEAR THERMAL EXPANSION COEFFICIENT $\alpha_{CARBON\ STEEL} = 6.5 \times 10^{-6}$ IN/IN − °F. LINEAR THERMAL EXPANSION COEFFICIENT

EXAMPLE OF A PUMP HAVING CARBON STEEL HOUSING AND CARBON STEEL ROTOR $$\Delta CL = \Delta T \times [(\alpha_{CARBON\ STEEL}) \times t_{HOUSING}) - (\alpha_{CARBON\ STEEL}) \times t_{ROTOR})] \quad \text{EQ. 1}$$

$$\Delta CL = -330°\ F. \times [(6.5 \times 10^{-6}\ IN/IN - °F. \times 0.5005\ IN) - (6.5 \times 10^{-6}\ IN/IN - °F. \times 0.5000\ IN)]$$

$\Delta CL$ = −0.00000107 INCHES

OPERATING END CLEARANCE (@ −260° F.) = −0.00000107 + 0.0005 = 0.0004989 INCHES

% CHANGE = −0.2%

On the other hand if one utilizes brass rather than carbon steel for the support housing, based on the following calculations it can be seen that the gerotor fuel pump would experience a change of minus 159% in the end-clearance. The rotor would be seized at operating temperature.

EXAMPLE OF A PUMP HAVING BRASS HOUSING AND CARBON STEEL ROTOR $$\Delta CL = \Delta T \times [(\alpha_{BRASS}) \times t_{HOUSING}) - (\alpha_{CARBON\ STEEL}) + t_{ROTOR})] \quad \text{EQ. 1}$$

$$\Delta CL = -300°\ F. \times [(11.3 \times 10^{-6}\ IN/IN - 20\ F. \times 0.5005\ IN) - (6.5 \times 10^{-6}\ IN/IN - °F. \times 0.5000\ IN)]$$

$\Delta CL$ = −0.000794 INCHES

OPERATING END CLEARANCE (@ −260° F.) = −0.000794 + 0.0005 =

-continued 0.000294 INCHES

% CHANGE = −159%

Accordingly, from the above it can be concluded that because the effect of the temperature change on the gerotor fuel pump 28 made according to the present invention is so small relative to a pump having the rotors and the support housing made of different materials, the pump can be manufactured to design operating end-clearance dimensions without regard to operating temperature or manufacturing temperature. For the same reason, one can conclude that having the support housing 64 and the rotors 56 and 60 of essentially the same width dimension and fabricated of the same material permits one configuration to be used at any temperature within a wide temperature range without significant change in pump efficiency. This is so because the thermal expansion of the support housing 64 and of the associated inner and outer rotors 56 and 60 while pumping super-heated fluid and the thermal contraction of the support housing 64 and of the inner and outer rotors 56 and 60 while pumping super-cooled fluid does not adversely affect the end-clearance between the associated end plates and the inner and outer rotors 56 and 60 to an extent where the efficiency of the pump would differ if it were pumping fluid at a temperature of 70 degrees Fahrenheit. Obviously, the similar design considerations are equally applicable to the scavenge pump 30 which, in this instance, is combined with the gerotor fuel pump 28.

Various changes and modifications can be made in the construction of the gerotor pump described above without departing from the spirit of the invention. Such changes and modifications are contemplated by the inventors and they do not wish to be limited except by the scope of the appended claims.

The embodiments of the invention in which an exclusive property or privilege is claimed are defined as follows:

1. A positive displacement hydraulic pump for use with super-cooled and super-heated fluids of low lubricity and viscosity and for use with such fluids at a temperature between the temperatures of said super-heated and super-cooled fluids, said hydraulic pump comprising an inner rotor, a ring-shaped outer rotor having a plurality of internal teeth and being formed with an outer cylindrical surface, said inner rotor having a plurality of external teeth formed thereon in meshing engagement with said internal teeth of said outer rotor, a ring-shaped stationary support housing for said inner and outer rotors, an inner cylindrical surface formed in said support housing, a plurality of roller bearings interposed between and in direct contact with said inner cylindrical surface of said support housing and the outer cylindrical surface of said outer rotor, a pair of end plates fixed to said support housing and cooperating with the latter to enclose said inner and outer rotors, a drive shaft extending through said pair of end plates for driving connection with said inner rotor, one of said pair of end plates having a fluid inlet port formed therein and the other of said pair of end plates having a fluid outlet port formed therein, said inlet port and said outlet port being located relative to said inner and outer rotors so that rotation of said inner rotor and said outer rotor creates an expanding chamber adjacent said inlet port for drawing fluid therein while simultaneously creating a contracting chamber adjacent said outlet port for forcing the fluid through said outlet port at a high pressure, said support housing and said inner and outer rotors being made of the same metallic material and having essentially the same width dimension along the rotational axis of said drive shaft so that the thermal expansion of said support housing and of said inner and outer rotors while pumping super-heated fluid and the thermal contraction of said support housing and of said inner and outer rotors while pumping super-cooled fluid does not adversely affect the end-clearance between the end plates and the inner and outer rotors to an extent where the efficiency of the pump would differ if it were pumping fluid at a temperature of 70 degrees Fahrenheit, and said roller bearings being made of a metallic material different than the metallic material of said support housing and said inner and outer rotors so as to avoid material transfer and molecular bonding between said outer rotor and said support housing.

2. A positive displacement hydraulic pump for use with super-cooled and super-heated fluids of low lubricity and viscosity and for use with such fluids at a temperature between the temperatures of said super-heated and super-cooled fluids, said hydraulic pump comprising an inner rotor, a ring-shaped outer rotor having a plurality of internal teeth and being formed with an outer cylindrical surface, said inner rotor having a plurality of external teeth formed thereon in meshing engagement with said internal teeth of said outer rotor, said external teeth formed on said inner rotor being at least one less in number than the number of internal teeth formed on said outer rotor, said inner rotor having its axis of rotation positioned at a fixed eccentricity from the axis of rotation of said outer rotor and said external teeth of said inner rotor and said internal teeth of said outer rotor having generated tooth profiles for maintaining continuous fluid tight contact during rotation of said inner and outer rotors, a ring-shaped stationary support housing for said inner and outer rotors, an inner cylindrical surface formed in said support housing, a plurality of roller bearings interposed between and in direct contact with said inner cylindrical surface of said support housing and the outer cylindrical surface of said outer rotor, a pair of end plates fixed to said support housing and cooperating with the latter to enclose said inner and outer rotors, a drive shaft extending through said pair of end plates for driving connection with said inner rotor, one of said pair of end plates having a fluid inlet port formed therein and the other of said pair of end plates having a fluid outlet port formed therein, said inlet port and said outlet port being located relative to said inner and outer rotors so that rotation of said inner rotor and said outer rotor creates an expanding chamber adjacent said inlet port for drawing fluid therein while simultaneously creating a contracting chamber adjacent said outlet port for forcing the fluid through said outlet port at a high pressure, said support housing and said inner and outer rotors being made of the same metallic material and having essentially the same width dimension along the rotational axis of said drive shaft so that the thermal expansion of said support housing and of said inner and outer rotors while pumping super-heated fluid and the thermal contraction of said support housing and of said inner and outer rotors while pumping super-cooled fluid does not adversely affect the end-clearance between the end plates and the inner and outer rotors to an extent where the efficiency of the pump would differ if it were pumping fluid at a temperature of 70 degrees Fahrenheit, and said roller bearings being made of a metallic material different than the metallic material of said support housing and said inner and outer rotors so as to avoid material transfer and molecular bonding between the outer rotor and the support housing.

3. The hydraulic pump of claim 2 wherein said internal teeth of said outer rotor have generated tooth profiles for maintaining continuous fluid tight contact during rotation of said inner and outer rotors.

4. A multi-stage positive displacement hydraulic pump for use with super-cooled and super-heated fluids of low lubricity and viscosity and for u se with such fluids at a temperature between the temperatures of said super-heated and super-cooled fluids, each stage of said hydraulic pump comprising an inner rotor, an outer rotor and a ring shaped stationary support housing circumferentially surrounding said inner rotor and said outer rotor, said outer rotor having a plurality of internal teeth and being formed with an outer cylindrical surface, said inner rotor having a plurality of external teeth formed thereon in meshing engagement with said internal teeth of said outer rotor, an inner cylindrical surface formed in said support housing, a plurality of roller bearings interposed between and in direct contact with said inner cylindrical surface of said support housing and the outer cylindrical surface of said outer rotor, a pair of end plates fixed to said support housing at each stage of said pump and cooperating with the support housing to enclose said inner and outer rotors, a drive shaft extending through said pair of end plates for driving connection with said inner rotor at each stage of said pump, one of said pair of end plates having a fluid inlet port formed therein and the other of said pair of end plates having a fluid outlet port formed therein, said inlet port and said outlet port being located relative to the associated inner and outer rotors so that rotation of said inner rotor and said outer rotor creates an expanding chamber adjacent said inlet port for drawing fluid therein while simultaneously creating a contracting chamber adjacent said outlet port for forcing the fluid through said outlet port at a high pressure, said support housing and said inner and outer rotors at each stage of said pump being made of the same metallic material and having essentially the same width dimension along the rotational axis of said drive shaft so that the thermal expansion of said support housing and of said inner and outer rotors while pumping super-heated fluid and the thermal contraction of said support housing and of said inner and outer rotors while pumping super-cooled fluid does not adversely affect the end-clearance between the end plates and the inner and outer rotors to an extent where the efficiency of the pump would differ if it were pumping fluid at a temperature of 70 degrees Fahrenheit, and said roller bearings being made of a metallic material different than the metallic material of said support housing and said inner and outer rotors so as to avoid material transfer and molecular bonding between said outer rotor and said support housing.

5. The hydraulic pump of claim 4 wherein said pump has three stages and wherein the inner rotor of the first and third stages of the pump are located in the same positions and the inner rotor of the second stage is offset one-half tooth from the first and third stages so as to reduce pressure spikes and avoid hydraulic locking of the pump caused by uneven flow of the fluid.

6. The hydraulic pump of claim 4 wherein said pump is connected to a scavenge pump having similarly constructed inner and outer rotors and encased within a support housing.

7. The hydraulic pump of claim 6 wherein said hydraulic pump is separated from said scavenge pump by a divider element.

8. The hydraulic pump of claim 7 wherein said combined hydraulic pump and said scavenge pump are located in a cylindrical tank and said divider member including sealing means for dividing said tank into an upper chamber wherein said hydraulic pump is located and a lower chamber wherein said scavenge pump is located.

9. The hydraulic pump of claim 8 wherein said first stage of said hydraulic pump has side inlet ports through which fluid is drawn from said upper chamber into said first stage of said hydraulic pump.

10. The hydraulic pump of claim 9 wherein said cylindrical tank is located in a primary tank and includes inlet ports through which fluid located in said primary tank flows into the lower chamber of said cylindrical tank.

* * * * *